US008432330B2

(12) United States Patent
Kazantsev et al.

(10) Patent No.: US 8,432,330 B2
(45) Date of Patent: Apr. 30, 2013

(54) ELECTROMAGNETIC SCREEN

(75) Inventors: Yury Nikolaevich Kazantsev, Moscow (RU); Vladimir Nikolaevich Apletalin, Moscow (RU); Vadim Anatolievich Kaloshin, Moscow (RU)

(73) Assignee: Samsung Electronics Co., Ltd., Suwon-si (KR)

( * ) Notice: Subject to any disclaimer, the term of this patent is extended or adjusted under 35 U.S.C. 154(b) by 562 days.

(21) Appl. No.: 12/179,823

(22) Filed: Jul. 25, 2008

(65) Prior Publication Data

US 2009/0025973 A1 Jan. 29, 2009

(30) Foreign Application Priority Data

Jul. 25, 2007 (RU) ..... 2007128677

(51) Int. Cl.
*H01Q 15/02* (2006.01)
*H01Q 19/06* (2006.01)

(52) U.S. Cl.
USPC ..... 343/909; 343/753

(58) Field of Classification Search ..... 343/700 MS, 343/846, 848, 853, 909, 753
See application file for complete search history.

(56) References Cited

U.S. PATENT DOCUMENTS

| | | | | |
|---|---|---|---|---|
| 6,411,261 | B1 * | 6/2002 | Lilly | 343/756 |
| 6,483,480 | B1 | 11/2002 | Sievenpiper | |
| 6,552,696 | B1 * | 4/2003 | Sievenpiper et al. | 343/909 |
| 6,897,831 | B2 * | 5/2005 | McKinzie et al. | 343/909 |
| 6,917,343 | B2 * | 7/2005 | Sanchez et al. | 343/795 |
| 7,071,888 | B2 | 7/2006 | Sievenpiper | |
| 7,209,083 | B2 | 4/2007 | Fujishima | |
| 2003/0011522 | A1 * | 1/2003 | McKinzie et al. | 343/700 MS |
| 2004/0160367 | A1 * | 8/2004 | Mendolia et al. | 343/700 MS |
| 2005/0134522 | A1 * | 6/2005 | Waltho | 343/909 |
| 2007/0159401 | A1 * | 7/2007 | Baliarda et al. | 343/702 |
| 2010/0066629 | A1 * | 3/2010 | Sievenpiper | 343/834 |

FOREIGN PATENT DOCUMENTS

| | | |
|---|---|---|
| RU | 2168878 | 6/2001 |
| RU | 51329 U1 | 1/2006 |
| SU | 1490696 | 6/1986 |
| WO | 02-49146 | 6/2002 |

OTHER PUBLICATIONS

Romulo F. Jimenez Broas, et al., "A High-Impedance Ground Plane Applied to a Cellphone Handset Geometry", IEEE Transactions on Microwave Theory and Techniques, vol. 49, No. 7, Jul. 2001, pp. 1262-1265.

Jon Anders Aas, "Plane-Wave Reflection Properties of Two Artificially Hard Surfaces", 8082 IEEE Transactions on Antennas and Propagation, 39 May 1991, No. 5, New York, US, pp. 651-656.

European Search Report dated Nov. 17, 2008.

(Continued)

*Primary Examiner* — Robert Karacsony
(74) *Attorney, Agent, or Firm* — H.C. Park & Associates, PLC

(57) ABSTRACT

The device according to an exemplary embodiment of the present invention relates to an area of wireless communication and can be used for shielding from electromagnetic radiation. The electromagnetic screen with the big surface impedance contains a flat metal reflector substrate and two lattices of capacitor type that are shifted from each other on a share of the period in parallel and located above the reflector substrate. At least one of lateral edges of the lattices has an electric connection with an edge of the reflector substrate.

15 Claims, 6 Drawing Sheets

OTHER PUBLICATIONS

Yu N. Kazantzev, et al., "Artificial Magnetic Conductors Based on Capacitive Gratings", ISSN 1064-2269, Journal of Communications Technology and Electronics, 2007, vol. 52, No. 4, pp. 390-398.

Russian Office Action dated Feb. 6, 2009.

RU Decision on Grant dated Jul. 21, 2009.

Dan Sievenpiper et al., "High-Impedance Electromagnetic Surfaces with a Forbidden Frequency Band," IEEE Transactions on Microwave Theory and Techniques, vol. 47, No. 11, Nov. 1999, pp. 2059-2074.

Dan Sievenpiper et al., Corrections to "High-Impedance Electromagnetic Surfaces with a Forbidden Frequency Band", IEEE Transactions on Microwave Theory and Techniques, vol. 48, No. 4, Apr. 2000, pp. 620.

A. Kumar, Comments on "High-Impedance Electromagnetic Surfaces with a Forbidden Frequency Band", IEEE Transactions on Microwave Theory and Techniques, vol. 49, No. 1, Jan. 2001, pp. 228.

O. S. Ostrovsky, et al., "Filters and Absorbers of Electromagnetic Waves," ФІП ФИП PSE (Ukraine), vol. 1, No. 2, pp. 161-173, Jun. 12, 2003.

Jiunn-Nan Hwang, et al., "Reduction of the Peak SAR in the Human Head with Metamaterials," IEEE Trans. on Antennas and Propag., pp. 3763-3770, vol. 54, No. 12 Dec. 2006.

Yu. N. Kazantsev, et al., "Electromagnetic Wave Backscattering from Structures with Anisotropic Conductivity," Proc. IX International Conf. on Spin-Electronics, Nov. 2000, Moscow (Firsanovka), UNC-1 MPEI (TU).

V. N. Apletalin, et al., "Centimeter and Millimeter Waves Reflectometers on a Basis Hollow Metal-Dielectric Waveguides," РаДИОТеХНИКа (Ukraine) No. 8, pp. 44-46, Aug. 2005.

* cited by examiner

ELECTROMAGNETIC SCREEN

CROSS REFERENCE TO RELATED APPLICATION

This application claims priority from and the benefit of Russian Patent Application No. 2007128677, filed on Jul. 25, 2007, which is hereby incorporated by reference for all purposes as if fully set forth herein.

BACKGROUND OF THE INVENTION

1. Field of the Invention

The present invention relates to a device for shielding electromagnetic radiation.

2. Discussion of the Background

The problem of designing screens for electromagnetic radiation has a long history. Since the development of radio engineering and electronics, the question of suppression of electromagnetic communication between separate circuits and units has been dealt with. Of equal concern is the reduction of the influence of electromagnetic radiation on surrounding wildlife and humans.

Conventional screens include metallic structures (metal sheets, a film, a grid etc.) and radio absorbing materials, as disclosed by O. S. Ostrovsky, et al.: "Filters and absorbers of electromagnetic waves," ФПП ФИП PSE (Ukraine), 2003, Vol. 1, No 2, pp. 161-173. Significant progress in the area of radio absorbing materials has been achieved for last 30 years in connection with works on a direction which usually designated as "Stealth". Screens including a composite magnetic-dielectric in a microwave range have been developed thin enough (thickness about units of millimeters), broadband (more an octave) radio absorbing coverings which can be applied to electromagnetic shielding successfully. However, it was known that in order for screens of both types to effectively shield electromagnetic radiation, their cross-section sizes should be equal to many wave-lengths. Over the last decade, and in particular in connection with development of mobile communication, the need for screens that are small in comparison to length of a wave for shielding radiation has grown. Simple reduction of the cross-sectional sizes of metallic and radio-absorbing screens does not give an essential positive effect because electromagnetic waves may easily flow around such screens. For example, the miniscreen "Wave Buster" (South Korea) made in the form of a 15 mm diameter tablet that is 4 mm thick on the basis of layered radio-absorbing material decreases the radiation of the aerial of all on 10-20%, i.e. less than on 1 dB. And as disclosed by Jiunn-Nan Hwang, et al.: "Reduction of the Peak SAR in the Human Head with Metamaterials," IEEE Trans. on Antennas and Propag., 54, December 2006, the plate of a radio-absorber (ferrite) of the greater area (45×45×6 mm) decreases the radiation on 6 dB for frequency of 0.9 GHz.

Radical change of the situation with the shielding of small aerials should be connected to publications of D. Sievenpiper and others (see U.S. Pat. No. 6,483,480, D. Sievenpiper, et al.; Sievenpiper D. et al.: "High-Impedance Electromagnetic Surfaces with a Forbidden Frequency Band," IEEE Trans. on Microwave Theory and Tech., vol. 47, November 1999, pp. 2059-2074; Jimenez Broas, et al.: "High-Impedance Ground Plane Applied to Cellephone Handset Geometry," IEEE Trans. on Microwave Theory and Tech., v. 49, July 2001, pp. 1262-1265) in which surfaces with a high surface impedance are considered. Such surfaces differently name artificial magnetic conductors (AMC) as at falling an electromagnetic wave on this surface the tangential magnetic field has a node instead of an antinode, as on a surface of an electric conductor. In particular, it is shown that behind such surfaces, even with a limited cross-section size, the area of a deep electromagnetic shadow is formed, i.e. the surface is the screen of electromagnetic radiation. Also, it has been shown that application of a resonance high impedance surface as a ground plane of aerials increases its directivity. As disclosed by Jimenez Broas R. F. et al., for the model of the mobile phone antenna located on an AMC with sizes 25×50 mm, the "forward-back" ratio for a 2.5 GHz signal was about 10 dB.

Attempts to apply a metamaterial on the basis of double open rings to shielding have shown that the structure from 10 layers in volume 34×34×15 mm has an attenuation of 3 dB for 1.8 GHz, as disclosed by Jiunn-Nan Hwang, et al.

U.S. Pat. No. 6,483,480, which is incorporated herein by reference, discloses a tunable impedance surface. The one includes two two-periodic lattices from the metal squares parallel to a metallic ground on distance small in comparison with the length of a wave. The distance between lattices also is small in comparison with length of a wave. Each element of the first lattice nearest to a metal substrate is connected to a metal ground. This lattice is motionless. The second lattice, which is mobile, can be shifted to the first lattice so that the distance between lattices remains constant. The impedance in a plane of a mobile lattice depends on a frequency of electromagnetic radiation and geometry of lattices. The surface impedance is maximal near to resonant frequency of the given system. The resonance of system is the resonance of a large number of the connected elementary resonators. Each elementary resonator is formed by capacity between two elements of the mobile and motionless lattices and also inductance of the circuit including a site of a metal substrate and 2 next conductors connecting elements of the motionless lattice with a metal substrate.

The tunable impedance surface disclosed in U.S. Pat. No. 6,483,480 may have a non-uniform surface impedance due to the limited size. Elementary resonators at edges of an impedance surface are connected to a smaller number of the next resonators than elementary resonators in the center of an impedance surface. Thus, resonant frequencies of elementary resonators and corresponding local impedances depend on location of these resonators. An undesirable result of the non-uniform impedance is the "washing out" of the effect of shielding, (i.e. its reduction on working frequencies of the screen). Another problem with the tunable impedance surface disclosed in U.S. Pat. No. 6,483,480 is the complexity of the design in which a large number of shorting connections of all elements of a motionless lattice are connected with a conducting substrate.

SUMMARY OF THE INVENTION

The present invention provides a device that may have a greater and more homogeneous surface impedance for small screens that shield electromagnetic radiation in a working range of frequencies. The tangential component of an electric field on a surface of the device is non-zero and a tangential component of a magnetic field and hence and a surface current are close to zero. Thus, a screen according to an exemplary embodiment of the present invention is an artificial magnetic conductor (AMC). The electromagnetic wave radiated by an electric dipole or a monopole forms the area of a deep electromagnetic shadow behind the AMC. In particular, placing an electromagnetic screen, according to an exemplary embodiment of the present invention, between the aerial of mobile phone and a user's head may shield the user's head from electromagnetic radiation.

The present invention also provides a screen that may shield electromagnetic radiation of the aerial behind it and form the area of a shadow, (i.e. the pattern of the aerial has a minimum).

Additional features of the invention will be set forth in the description which follows, and in part will be apparent from the description, or may be learned by practice of the invention.

The specified technical result is reached because in the electromagnetic screen with the big surface impedance containing flat metallic reflector and two capacitor type parallel lattices located above the last shifted from each other on a part of the period and at least one of fringes of lattices has electric connection with an edge of reflector.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1A:
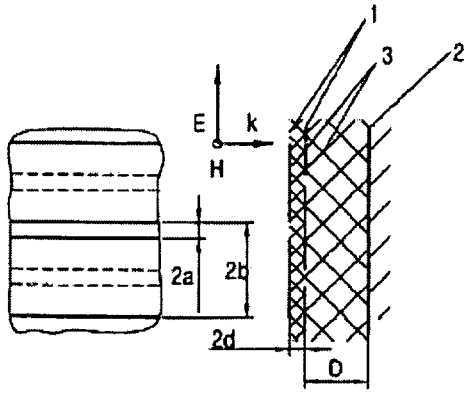
FIG. 1A and FIG. 1B show electromagnetic screens according to exemplary embodiments of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

Figure 1B:
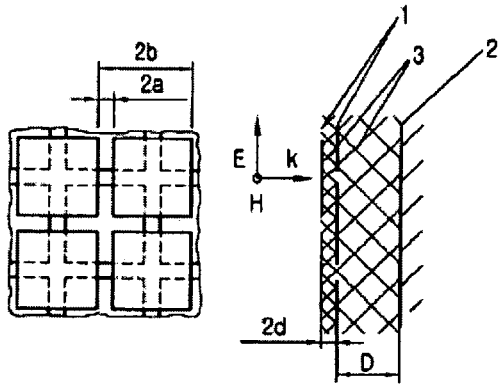
Figure 2A:
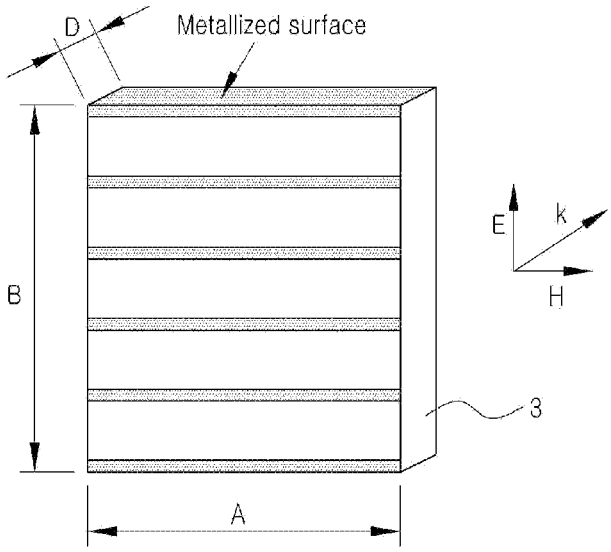
FIG. 2A and FIG. 2B show the arrangement of face surfaces of the electromagnetic screens according to exemplary embodiments of the present invention.
Figure 2B:
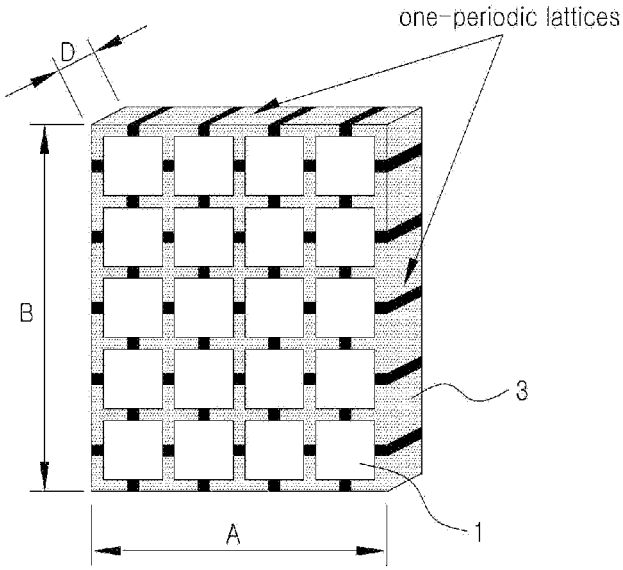

Referring to FIG. 1A and FIG. 1B, electromagnetic screens according to exemplary embodiments of the present invention include lattices 1 of a capacitor type, a reflector 2, and dielectric layers 3. Although FIG. 1A and FIG. 1B both show metal lattices, FIG. 1A shows strip lattices and FIG. 1B shows square lattices. FIG. 2A and FIG. 2B show the arrangement of face surfaces of the electromagnetic screens according to exemplary embodiments of the present invention with continuous metallization and metallization as one-periodic lattice and two-periodic lattice, respectively. This lattice is made from thin conductors with a small period in comparison with the cross-sectional sizes A and B of the electromagnetic screen.

Characteristics of an AMC with Large Cross-Sectional Sizes

As noted above, electromagnetic screens according to exemplary embodiments of the present invention are artificial magnetic conductors (AMC) due to their electromagnetic properties. The basic difference of an AMC from an electric conductor consists in the following: at falling an electromagnetic wave on surface AMC on this surface antinode of tangential component of electric field and node of a tangential component of a magnetic field are formed. Otherwise, the reflection coefficient of tangential component of an electric field is equal +1 for AMC instead of −1 as in the case of an electric conductor.

Patterns of AMC on the basis of two closely located capacitor lattices are shown in FIG. 1A and FIG. 1B. One-periodic lattices in FIG. 1A are made from thin metallic strips and two-periodic lattices in FIG. 1B are made from metallic squares. The sizes of these structures satisfy the conditions:

$$d<<a<<b<<\lambda \tag{1}$$

Where λ is wave-length.

The basic characteristics of an AMC are considered in detail in J. N. Kazantsev, et al.: "Artificial magnetic conductors on the basis of lattices of capacitor type," 52, February 2007. Here, we remark only some necessary results for AMC with the sizes there is more than length of a wave.

The capacitor lattices and a metal plane form the flat resonator the coefficient of reflection from which on resonant frequency is equal +1 (on a cross-component of an electric field). Resonant frequency $f_p$ at normal incidence a wave on AMC is estimated under the following formula:

$$f_p = \frac{c}{\pi\sqrt{2}\sqrt{\frac{\varepsilon Db(b-2a)}{d}}} \tag{2}$$

Where c is the speed of light and ∈ is the dielectric permeability of a material between lattices. The phase of coefficient of reflection (on a cross component of an electric field) varies in an interval±π/2 in a strip of frequencies 2Δf:

$$2\Delta f = f_p/Q \tag{3}$$

Where the coefficient Q is estimated under the following formula:

$$Q = \sqrt{\frac{\varepsilon b(b-2a)}{2dD}} \tag{4}$$

The module of coefficient of reflection from an AMC is less than 1 due to radiation and losses in metal and dielectric. The radiation is the reason of reduction of area AMC where the resonance eventually disappears. Thus, influences of two orthogonal sizes AMC on a resonance are essentially various.

So reduction of the size perpendicular to the direction of an electric field poorly influences resonant frequency down to the sizes comparable to distance between lattices and a metal plane. On the contrary, reduction of other size orthogonal to the first leads to an increase in resonant frequency already at the sizes smaller than length of a wave.

Characteristics of an AMC with Small Cross-Section Sizes

For designing small screens on the basis of AMC, the undesirable effect of radiation should be removed at its edges. For this purpose, in the case of the one-periodic (one-polarizing) structure in FIG. 1A, there may be continuous metallization of two face surfaces perpendicular to a vector of an electric field (see FIG. 2A). Partial elimination of undesirable effect of radiation may take place even if the metallization is on one face surface. In the case of the two-periodic (two-polarizing) structure in FIG. 1B, metallization of all face surfaces is carried out in the form of a lattice from thin conductors (see FIG. 2B). In the latter case, metallization of end faces perpendicular to a vector $\vec{E}$ of an electric field behaves as continuous and metallization of two staying end faces should not influence appreciably a field in resonant volume between pair lattices and a metal plane as conductors of lattices here are perpendicular to a vector $\vec{E}$. As a result, a screen according to an exemplary embodiment of the present invention formed of such AMC represents the flat resonator formed in pair of lattices, a metal plane, and metallized end faces.

An electromagnetic wave falling on a screen (mini-screen) according to an exemplary embodiment on resonant frequency it is formed antinode by a tangential component of an electric field and node—magnetic on its surface. The band of frequencies of the mini-screen is determined by resonant frequency and Q-factor of the resonator.

In comparison with a conventional screen, the technical result—uniformity of an impedance on surface of an AMC of the limited size—may be reached by that a screen according to an exemplary embodiment represents the uniform resonator with the certain resonant frequency and a homogeneous field of its mode in a plane of capacitor lattices. It is natural that periodic oscillations of a field along lattices are not taking in attention at definition of the impedance.

Resonant Frequency of the Electromagnetic Screen

Figure 3A:
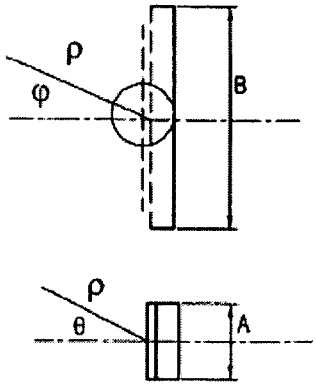
FIG. 3A and FIG. 3B show electromagnetic screens according to exemplary embodiments of the present invention.
Figure 3B:
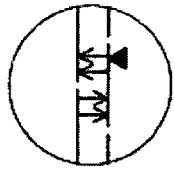

A screen according to an exemplary embodiment of the present invention represents the resonator in which it is easy to allocate capacity and inductance as the electric field is concentrated between lattices and magnetic—in volume between pair lattices, a metal plane, and metallized end faces. Therefore, the capacity of the resonator is formed by elements of lattices, and inductance is determined by volume of an internal cavity of the resonator. The further calculations will be carried out for the one-periodic structure represented in FIG. 1A and FIG. 2A. Results of these calculations are right for the two-periodic structures represented in FIG. 1B and FIG. 2B too as the sizes of slots (2*a*) are small in comparison with the period (2*b*) of the lattices. The capacity of the resonator C is generated by consecutive connection of 2n flat condensers where "n" is the number of metal strips of an external lattice (see FIG. 3):

$$C = \frac{\varepsilon A(b-2a)}{16\pi dn} \tag{5}$$

The internal cavity of the resonator has the form of a tube of rectangular section B×D. Inductance L of such a tube under condition of A>>D is estimated by the following formula:

$$L = \frac{4\pi BD}{A} \tag{6}$$

Resonant frequency $f_p$ can be calculated under known formula $$f_p = \frac{c}{2\pi\sqrt{LC}} \tag{7}$$

Having substituted in (7) expressions (5) and (6) we shall obtain:

$$f_p = \frac{c}{\pi\sqrt{\frac{\varepsilon(b-2a)BD}{dn}}} \tag{8}$$

At the big number of the periods of a lattice it is possible to count that B/n≈2b and formula (8) transforms in the formula (2). Here, in the case of two-periodic structure, formula (8) should be slightly specified:

$$f_p = \frac{c}{\pi\sqrt{\frac{\varepsilon(b-4a)BD}{dn}}} \tag{9}$$

Resonant frequency was measured for a series of samples with identical structure of lattices (2*b*=4 MM, 2*a*=0.3 mm, 2*d*=0.1 mm) and identical thickness D but different in the cross-section sizes A and B. The sizes of samples are shown below in Table 1. Dielectric permittivity of the material between lattices 1 and between the lattice 1 and a metal plane 2 is equal 2.25 and 2.55, respectively.

TABLE 1

| Sample N | A mm | B mm | D mm | 2n | fm GHZ measured | fc GHz calculated |
|---|---|---|---|---|---|---|
| 1 | 11 | 24 | 3.40 | 10 | 2.84 | 2.70 |
| 2 | 20 | 25 | 3.45 | 10 | 2.72 | 2.63 |
| 3 | 20 | 35 | 3.45 | 16 | 2.7 | 2.81 |
| 4 | 20 | 18 | 3.45 | 6 | 2.52 | 2.4 |
| 5 | 6.8 | 24 | 3.45 | 10 | 3.02 | 2.68 |
| 6 | 4.8 | 24 | 3.45 | 10 | 3.53 | 2.68 |

Figure 4:
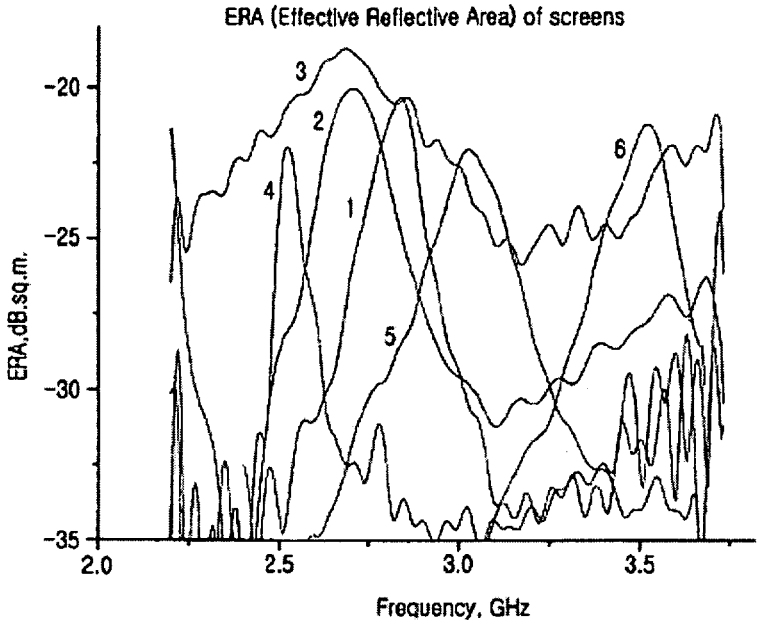
FIG. 4 is a graph showing resonant frequencies.

Resonant frequency was determined on a maximum of frequency dependence of radar cross section (RCS) of a sample in space. RCS measurements were carried out in compact range polygon IRE RAS, per Yu. N. Kazantsev, et al.: "Electromagnetic Wave Backscattering from Structures with Anisotropic Conductivity," Proc. IX International Conf. on Spin-Electronics, November 2000, Moscow (Firsanovka), UNC-1 MPEI (TU)), with the use the quasioptical reflectometer, per V. N. Apletalin, et al.: "Centimeter and millimeter waves reflectometers on a basis hollow metal-dielectric waveguides,", August 2005, pp. 44-46, complete with the vector analyzer. The dependences in dB relative M in power 2 are presented in FIG. 4. The reference numerals 1-6 on the curves of FIG. 4 correspond to numbers of samples N in Table 1. From the presented curves follows:

Resonant frequency poorly depends on the cross-sectional sizes of a sample at condition A/D>2.

The width of a resonant curve poorly depends on the size A but quickly grows with increase in the size B.

Values of resonant frequencies measured and calculated using the formula (8) are shown in Table 1. As one would expect under condition of A>>D, good correlation takes place between experimental and calculated results. At A comparable with D, the measured value of resonant frequencies is essentially more than calculated one.

Estimation of Effect of Shielding:

An explanation of the effect of shielding of electromagnetic radiation of AMC structures is a little electric current on a surface of the AMC near to resonant frequency, as discussed in O. S. Ostrovsky, et al. and U.S. Pat. No. 6,483,480. The experimental estimation of effect of shielding was carried out in practically important ranges near to frequencies of 1.8 GHz and 2.5 GHz. The samples of mini-screens were made on the basis of one-periodic and two-periodic lattices. All lattices had the following parameters: 2*b*=6 mm, 2*a*=0.3 mm and 2*d*=0.1 mm. Permittivity of materials between lattice 1 and between the lattice 1 and a metallic plane 2 are $\in$=2.25 (polythene) and $\in_1$=2.55 (polystyrene), respectively.

Overall dimensions of samples and other characteristics are shown in Table 2. Resonant frequencies $f_p$ in the table are calculated under formulas (8) and (9). In samples 1-3, electric connection between lateral edges of lattices and an edge of a reflector is made by continuous metallization of two opposite face surfaces. In a sample 4, electric connection is made on all four face surfaces in the form of two-periodic lattice from thin conductors with 6 mm period.

TABLE 2

| Sample N | Type of lattices | A cm | B cm | D cm | fm GHZ measured | fc GHz calculated |
|---|---|---|---|---|---|---|
| 1 | One periodic | 2.0 | 4.5 | 0.427 | 1.75 | 1.69 |
| 2 | One periodic | 1.0 | 4.5 | 0.445 | 1.75 | 1.62 |
| 3 | One periodic | 2.0 | 3.3 | 0.377 | 1.91 | 1.72 |
| 4 | Two-periodic | 3.3 | 3.3 | 0.227 | 2.49 | 2.33 |

Figure 5:
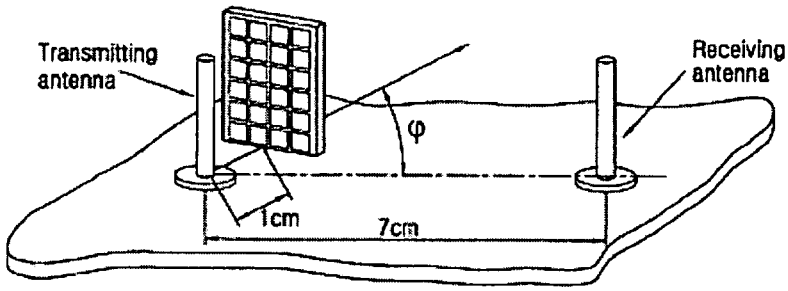
FIG. 5 shows a system used to measure resonant frequencies.
Figure 6A:
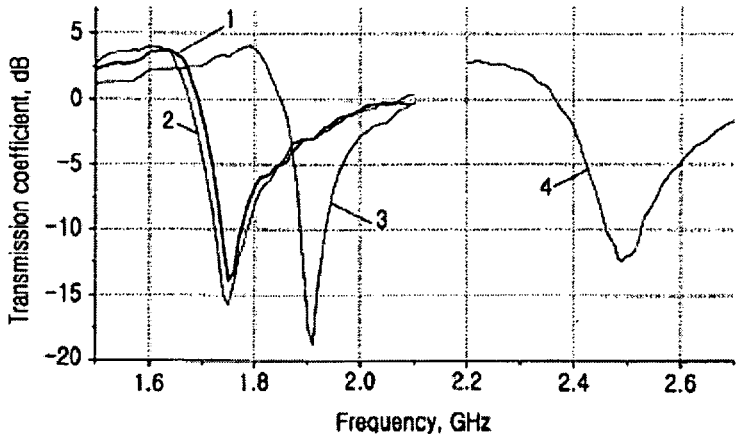
FIG. 6A and FIG. 6B show a frequency and angular dependence of the coefficient of transmission, respectively.
Figure 6B:
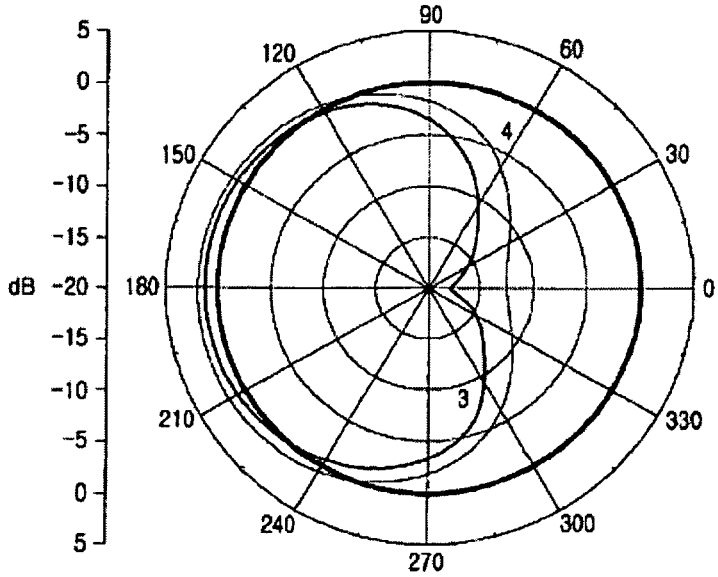

The measuring equipment is shown in FIG. 5. The level of shielding was determined by measurement of coefficient of transmission between two monopoles in length of 30 mm. The frequency dependence of the normalized coefficient of transmission is shown in FIG. 6A in case of $\phi$=0. The angular dependence of coefficient of transmission on frequency fin for which this coefficient is minimal (is resulted in case of $\phi$=0) is shown in FIG. 6B. The figures on the curves of FIG. 6A and FIG. 6B correspond to numbers of samples N in Table 2. Measurements have shown that frequencies of shielding fin depend and on the sizes of the structure of lattices and also thickness of a sample D and practically do not depend on the cross-sectional sizes A and B. In FIG. 6A and FIG. 6B, the effect of shielding more than 15 dB is observed.

Thus, an electromagnetic screen according to an exemplary embodiment of the present invention carries out the function of shielding of electromagnetic radiation at the cross-sectional sizes essentially smaller than length of a wave. For realization of effective shielding radiation of aerials such as an electric dipole or an electric monopole, the screen sets down on distance (0.01÷0.1) length of a wave from a surface of the aerial. Thus, the surface of capacitor lattices is parallel to an axis of the aerial and faces the aerial.

An electromagnetic screen according to an exemplary embodiment of the present invention may decrease electromagnetic radiation of aerials more than on 15 dB in a direction of the maximal shielding at distances between it and the aerial essentially smaller than length of a wave.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

The invention claimed is:

1. An electromagnetic screen having a high surface impedance, the screen comprising:

a reflector substrate, wherein the reflector substrate has a rectangle shape, wherein the rectangle shape is defined by four lateral edges;

a lattice structure comprising a first lattice and a second lattice parallel to the first lattice, the lattice structure being located above the reflector substrate, the lattice structure being arranged in a two period lattice, wherein at least one edge of the four lateral edges has at least one electric connection with a respective edge of the lattice structure, and wherein portions of the lattice structure other than the respective edges do not have a direct electric connection with the reflector substrate.

2. The electromagnetic screen of claim 1, wherein the electric connection comprises a metal layer located on at least one opposite face surface of the screen.

3. The electromagnetic screen of claim 1, wherein the lattice structure comprises a two-period lattice and wherein the electric connection comprises a metal layer that is coupled to a face surface of the screen.

4. The electromagnetic screen of claim 1, wherein the edge of the reflector substrate is a peripheral edge of the reflector substrate.

5. An electromagnetic screen, comprising:

a reflector substrate, wherein the reflector substrate has a rectangle shape, wherein the rectangle shape is defined by four lateral edges;

a first dielectric layer on the reflector substrate;

a first thin metal layer on the first dielectric layer, the first thin metal layer comprising a first plurality of pieces spaced apart in a two period lattice;

a second dielectric layer on the first thin metal layer;

a second thin metal layer being arranged in parallel with the first thin metal layer and on the second dielectric layer, the second thin metal layer comprising a second plurality of pieces spaced apart from each other by a first distance; and a first connector to connect a first edge of the first thin metal layer to at least one lateral edge of the four lateral edges of the reflector substrate, the first connector being disposed on a first surface of the first dielectric layer, wherein among the first plurality of pieces in the first thin metal layer, those pieces not located on edges of the first thin metal layer do not have a direct electric connection with the reflector substrate.

6. The electromagnetic screen of claim 5, further comprising a second connector to connect a second edge of the first thin metal layer to a second edge of the reflector substrate, the second connector being disposed on a second surface of the first dielectric layer, wherein the second surface of the first dielectric layer opposes the first surface of the first dielectric layer.

7. The electromagnetic screen of claim 6, wherein each of the first connector and the second connector comprise a metal layer.

8. The electromagnetic screen of claim 6, further comprising:

a third connector to connect a third edge of the first thin metal layer to a third edge of the reflector substrate, the third connector being disposed on a third surface of the first dielectric layer; and a fourth connector to connect a fourth edge of the first thin metal layer to a fourth edge of the reflector substrate, the fourth connector being disposed on a fourth surface of the first dielectric layer;

wherein the third surface of the first dielectric layer opposes the fourth surface of the first dielectric layer.

9. The electromagnetic screen of claim 8, wherein each of the first connector, the second connector, the third connector, and the fourth connector comprise a metal layer.

10. The electromagnetic screen of claim 5, wherein each of the first plurality of pieces and the second plurality of pieces comprise metallic strips that extend across an entire width of the first dielectric layer.

11. The electromagnetic screen of claim 5, wherein each of the first plurality of pieces and the second plurality of pieces comprise metallic squares that each has a width less than a width of the first dielectric layer.

12. The electromagnetic screen of claim 5, wherein a permittivity of the first dielectric layer is greater than a permittivity of the second dielectric layer.

13. The electromagnetic screen of claim 5, wherein a thickness of the first dielectric layer is greater than a thickness of the second dielectric layer.

14. The electromagnetic screen of claim 5, wherein:

the first dielectric layer is directly on the reflector substrate;

the first thin metal layer is directly on the first dielectric layer;

the second dielectric layer is directly on the first thin metal layer;

the second thin metal layer is directly on the second dielectric layer; and the first connector is directly on the first surface of the first dielectric layer.

15. The electromagnetic screen of claim 5, wherein adjacent ones of the first plurality of pieces are interconnected via corresponding metallic connections.

* * * * *